United States Patent [19]

Lane et al.

[11] 4,369,886

[45] Jan. 25, 1983

[54] REFLECTANCE RATIO SORTING APPARATUS

[75] Inventors: Marvin M. Lane; Eric W. D. Garnett, both of Woodland, Calif.

[73] Assignee: Ag-Electron, Inc., West Sacramento, Calif.

[21] Appl. No.: 301,583

[22] Filed: Sep. 14, 1981

Related U.S. Application Data

[63] Continuation of Ser. No. 82,961, Oct. 9, 1979, abandoned.

[51] Int. Cl.[3] ..... B07C 5/342

[52] U.S. Cl. ..... 209/564; 209/580; 209/582; 209/587; 250/341; 356/72; 356/418

[58] Field of Search ..... 209/564, 565, 576, 577, 209/578, 580, 581, 582, 585, 587; 250/226, 233, 339, 341, 372; 356/72, 418, 420

[56] References Cited

U.S. PATENT DOCUMENTS

| | | | |
|---|---|---|---|
| 2,678,725 | 5/1954 | Jacobson | 209/581 X |
| 3,675,769 | 7/1972 | Story | 209/587 X |
| 3,776,381 | 12/1973 | Wood | 209/587 X |
| 4,081,362 | 3/1978 | Chamberlin et al. | 209/580 |
| 4,095,696 | 6/1978 | Sherwood | 209/581 X |
| 4,120,402 | 10/1978 | Swanson | 209/587 X |
| 4,134,498 | 1/1979 | Jones et al. | 209/587 X |
| 4,186,836 | 2/1980 | Wassmer et al. | 209/587 X |

FOREIGN PATENT DOCUMENTS

| | | | |
|---|---|---|---|
| 2319721 | 10/1973 | Fed. Rep. of Germany | 209/576 |
| 54-144662 | 11/1979 | Japan | 209/582 |

*Primary Examiner*—Robert B. Reeves
*Assistant Examiner*—Edward M. Wacyra
*Attorney, Agent, or Firm*—Lothrop & West

[57] ABSTRACT

An infrared light generator directs a flashing band of light across a conveyor belt carrying randomly spaced materials having differing properties. The frequency of the flashing band sequentially alternates between two infrared frequencies chosen for their peculiar reflectivity characteristics. Infrared light sensitive cells detect energy reflected from the passing materials as they are exposed to the infrared light. Comparator circuitry examines the detected information, determining the size and material nature of the passing pieces. Powered paddles act at the direction of the comparator, physically separating variously sized inorganic from organic materials, or ripe from unripe comestibles, to cite examples.

20 Claims, 11 Drawing Figures

LOW VOLTAGE POWER SUPPLY
10V.
5V.
V+

CHANNEL A
CHANNEL B

HIGH VOLTAGE(-)
24HZ
12HZ
TACH. GEN.
OUTPUT-I
OUTPUT-O
OUTPUT-D 39
42
43
44
46
47
48
51
52
53
54
55
29
C

REFLECTANCE RATIO SORTING APPARATUS

This application is a continuation of application Ser. No. 082,961, filed Oct. 9, 1979, now abandoned.

BACKGROUND OF THE INVENTION

Mechanical harvesters capable of uprooting and then denuding plants of their comestibles have vastly improved the speed and overall efficiency of the harvesting process. However, a major problem still attendant upon mechanical harvesting includes the initial sorting of comestibles from field debris and dirt clods. On the earliest harvesters, this primary sorting job was performed by a worker who visually examined the passing mixture of produce and debris and removed acceptable comestibles for further sorting. Manual sorting is not only labor consuming but also wastes produce that is discharged onto the ground before it can be manually removed from the transport conveyer.

When electronic sorters were first developed, colorimetry emerged as the most reliable and effective basis upon which to sort objects. The earliest colorimetry systems were monochromatic, but the later, more sophisticated systems used a bichromatic approach. Typical of these bichromatic systems are Swanson, U.S. Pat. No. 4,120,402 and Jones et al., U.S. Pat. No. 4,134,498. These systems use a source of constant light energy to bathe the subject materials. Then, dual detectors, each fitted with an appropriate filter, gather information regarding the reflected light. The dual detectors are interconnected to comparator circuitry which produces a reject signal if the input signals bear a predetermined relationship. The reject signal is fed to a powered ejector arm which deflects the unwanted object from the stream of articles.

The advantages of a bichromatic colorimetry sorter are manifest. The approach can be used for differentiating ripe from unripe comestibles, or organic from inorganic materials. Equally important, the signal to noise ratio afforded by the bichromatic system provides superior quality data for logic circuits to analyze than the monochromatic system, thus greatly increasing the reliability of the sorter apparatus.

Prior art bichromatic sorters do not perform well in separating organic from inorganic materials because the detectors used, generally photovoltaic silicon cells, are not sufficiently sensitive to the deep infrared light which inorganic materials reflect. Lead sulfide cells, however, perform well as deep infrared detectors, but have not been used successfully in prior art devices.

Changes in temperature drastically affect the resistance of the photoresistive lead sulfide cell. Variations between the temperaure sensitivity of individual cells result in different resistance values for a group of cells throughout a temperature spectrum. With the dual detector approach used in the prior art, temperature variations affect the relative resistance of two companion cells at differential rates. A relatively small change in ambient temperature demands recalibration of both detector circuits.

The requirement of frequent recalibration proved too time consuming and technically difficult to perform in the field. But without frequent recalibration, temperature variations encountered during in-field use of a dual detector sorter using lead sulfide detectors rendered the sorter unreliable and commercially unusable. Thus, the inability of prior art sorters to use the superior lead sulfide cell successfully stems from the use of two detectors to extract date from the reflected light.

The present invention, by changing the nature of the source of illumination, uses only one cell for detecting reflected light. Temperature variations do not degrade the reliability of the single detector cell system since the sensitivity of the material analysis circuitry can readily be adjusted, if necessary, to compensate for temperature-dependent sensitivity variations in a single lead sulfide detector cell. Furthermore, for ripe/unripe sorting, the single detector cell system can be used to advantage with the lower sensitivity, silicon detector cell as well.

Thus, it is an object of the present invention to provide a colorimetric process for differentiating organic from inorganic materials or ripe from unripe comestibles using a sequentially ordered illumination source and a single detector cell.

It is another object to provide a colorimetry system which is bichromatic in nature, extremely responsive to the appropriate infrared spectrum for differentiating organic from inorganic materials or ripe from unripe comestibles, yet uses a single cell for detecting reflected light.

It is a further object to disclose a unique illumination system which produces a sequentially ordered band of light of alternating infrared frequencies.

It is yet another object of the present invention to provide sizing circuitry which works in conjunction with the rejection system to ensure consistent rejection of inorganic materials or unripe comestibles regardless of their size. These and other objects and advantages of the present invention will be fully discussed and explained in the detailed description contained herein.

SUMMARY OF THE INVENTION

The present invention generally relates to sorting apparatus to be used in conjunction with a conveyer belt, or the like, which is passing comestibles and debris randomly disposed thereon. The sorting apparatus disclosed herein is capable of sorting and physically separating debris or unripe comestibles from the stream of passing articles.

Fruit and debris, just before passing off the end of the conveyer, is exposed to near simultaneous, sequential flashes of infrared light. A light chopping illumination source generates the flashes of light at two discrete frequencies. The two frequencies are chosen for their unique reflectivity constants, and different pairs of frequencies are used depending whether organic/inorganic or ripe/unripe sorting is to be performed. The two frequencies alternate in sequential fashion rapidly to ensure each object is exposed numerous times to each of the two frequencies.

A converging lens focused upon a particular area of the supply conveyer belt directs the light pulses reflected from an object passing therethrough to a detector cell. Comparator circuitry makes a determination, based upon the relative amplitudes of the detected information, whether the object conforms to a desired characteristic.

If the object is determined to be undesirable, a reject signal is passed to sizing circuitry. Based upon the duration of the reject signal, an object size determination is made. The reject signal is eliminated if the object does not meet a predetermined threshold size. If the threshold size is exceeded, sizing circuitry passes the reject signal to delay and stretch circuitry.

The reject signal is processed by the delay circuitry to compensate for the time differential between the near instantaneous determination of the object's material nature and the time-lagging physical removal of that object from the article stream. The stretch circuitry lengthens the duration of the delayed reject signal so that account is made for the inability of physical removal apparatus to act instantaneously in response to electrical signals.

The reject signal controls a solenoid air valve which cooperates with a paddle placed in the downward path of the object passing off the end of the supply conveyer. The activated air valve retracts support for the hinged paddle allowing the undesirable object to brush aside the paddle and fall downwardly into a reject chute. The circuitry immediately resets and actively returns the paddle to its normally protruding position. Should a desirable object be detected, it merely passes off the end of the supply conveyer, strikes the protruding paddle, and rebounds onto a return conveyer located beneath the supply conveyer.

A plurality of detectors and respective paddles provides a sorting apparatus capable of physically separating desirable from undesirable objects as they randomly pass along a supply conveyer. As mentioned, the invention disclosed herein can be used for sorting both inorganic from organic materials and ripe from unripe comestibles with reliability heretofore unattainable.

DETAILED DESCRIPTION OF THE PREFERRED EMBODIMENT

Since the immediate commercial advantages offered by the present invention are a process and apparatus capable of effectively physically separating inorganic from organic materials, the embodiment offered herein will describe in detail an inorganic-organic sorter. In a manner explained below, however, the process and apparatus are readily adaptable for sorting unripe from ripe comestibles, and it is to be understood that the present invention embraces both embodiments as well as variations thereof apparent to one skilled in the art.

Figure 2:
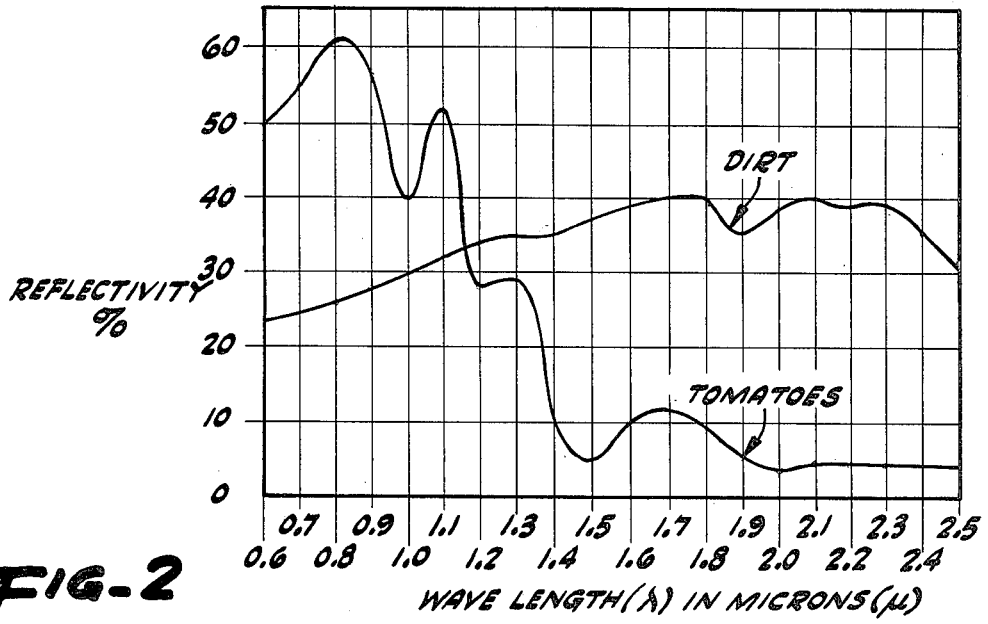
FIG. 2 is a graphic representation of the reflectivity for both dirt and tomatoes exposed to a plurality of test frequencies with a specific infrared light energy spectrum, frequency being shown in terms of wave length.

The light frequencies used in a bichromatic colorimetry system for sorting inorganic from organic materials are derived from the natural reflectivity characteristics of the materials to be sorted. Making reference to FIG. 2, reflected light energy, expressed as a percentage of incident light, is plotted against frequency, expressed as wave lengths in microns, for the two subject materials. Tomatoes exhibit a high, sharp, energy reflectance peak at 0.8 microns while dirt shows a moderately high, but broad peak at 1.8 microns. Fortunately, the reflectance of dirt at 0.8 microns is relatively low and the reflectance of tomatoes at 1.8 microns is quite low, indeed. It is this relative difference in reflectivity for tomatoes and dirt at two separate frequencies which provides the basis for bichromatic colorimetric sorting pursuant to the present invention.

Figure 3:
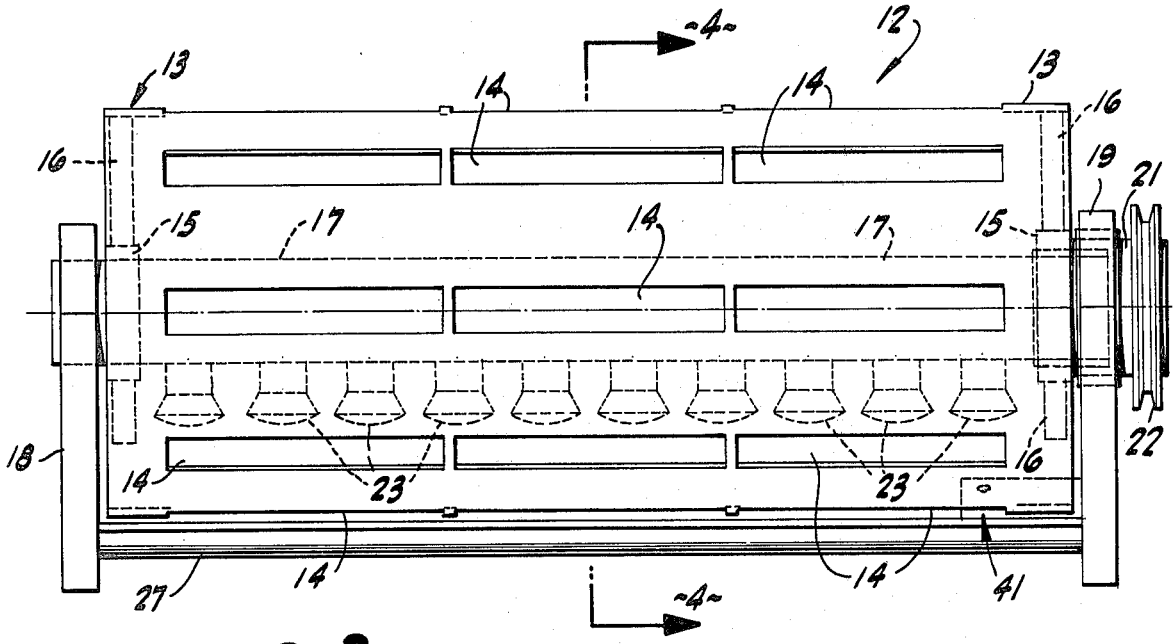
FIG. 3 is a side elevational view of the rotatable drum, the major element of the light splitting apparatus.

The present invention uses a dual frequency illuminator to produce sequentially ordered bursts of infrared light energy at 0.8 and 1.8 microns, for inorganic/organic sorting. The dual frequency illuminator 11 is shown generally in FIG. 1 and FIGS. 3 and 4 reveal specifics of its key element, a rotatable drum assembly 12 including a horizontally-disposed, hollow, right circular cylinder 13 having a plurality of circumferentially positioned, elongated apertures 14. Drum hubs 15 and spider arms 16 support and journal the cylinder 13 for rotation about axle 17. The left-hand extremity of axle 17, as seen in FIG. 3, is mounted on left-hand support bracket 18. Right-hand support bracket 19 provides a bearing for drum hub extension 21, which protrudes beyond the right-hand extremity of axle 17. Drive pulley 22 is attached to the right-hand end of sleeve extension 21 so that when in operation, cylinder 13 rotates when rotational torque is applied to drive pulley 22, and the axle 17 remains stationary, being constrained by left-hand support bracket 18 to which the axle 17 is secured.

A plurality of lamps 23 depends from the underside of fixed axle 17, the lamps being directed to illuminate an arcuate section of cylinder 13 immediately therebeneath. An infrared organic filter 24 and an infrared inorganic filter 26 are adjacently co-planar beneath and extend the full length of right cylinder 13, (see FIGS. 3 and 4). A convex in section bar lens 27 is positioned beneath and is co-extensive with the planar bottom surface of the filters 24 and 26.

Figure 1:
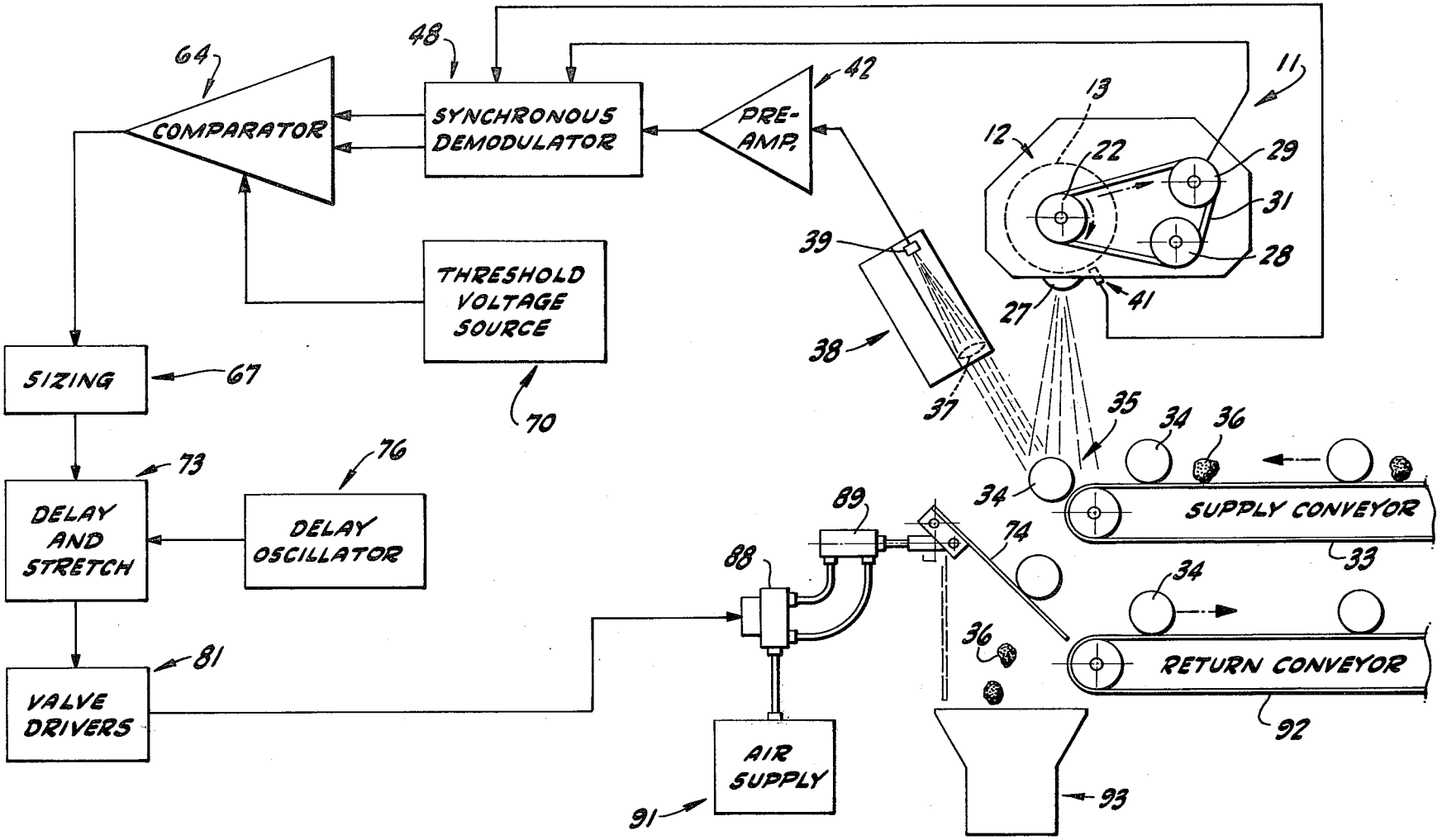
FIG. 1 is a schematic representation of the physical components of the invention shown interconnected to a block diagram of the associated electrical circuitry.

As shown in FIG. 1, drive motor 28, tach generator 29 and drive pulley 22 are interconnected by belt 31. As the drive motor 28 is energized, the cylindrical drum 13 begins to rotate in a clockwise fashion as viewed in FIG. 1. Light energy generated by the lamps 23 passes first through apertures 14 and then through filters 24 and 26 sequentially before being blocked by cylinder wall section 32.

The transverse dimensions of apertures 14, organic filter 24, and inorganic filter 26 are substantially identical. Cylinder wall section 32 is approximately twice the transverse dimension of apertures 14. This effects a repetitive, sequential pattern of light pulses emanating downwardly through the two infrared filters, each pair of pulses being separated by a blank dark period when cylinder wall section 32 blocks the illumination source, lamps 23.

The filtered pulse emanating downwardly from each filter is collected and directed by bar lens 27 to illuminate a relatively narrow transverse portion of the turnaround of discharge end of a supply conveyer 33. As FIGS. 3 and 4 reveal, there are 8 groups of apertures 14 equally spaced about the cylinder 13. Each full revolution of cylinder 13, therefore, produces 24 bits of information, i.e. eight sampling cycles with each sampling cycle consisting of a dark period followed by a pulse through filter 24 followed by a pulse through filter 26 as explained more fully herein; or, in the alternative, each sampling cycle can include a pulse through filter 24 followed by a pulse through filter 26 followed by a dark period.

Organic comestibles 34 and inorganic debris 36, randomly disposed upon the supply conveyer 33, emerge into a sampling zone 35 at the discharge end of the conveyer 33. As illustrated in FIG. 1, filtered, sequential pairs of pulses from the dual frequency illuminator 11 impinge upon comestibles 34 and debris 36, and a portion of the reflected energy reaches collector lens 37 within a detector assembly 38. Collector lens 37 focuses the pulses upon a lead-sulfide detector cell 39. While FIG. 1 shows a single lens 37 and cell 39 for purposes of simplicity, actual practice of the invention requires a plurality of lenses and respective cells to account for all articles passing through the sampling zone 35.

Figure 5:
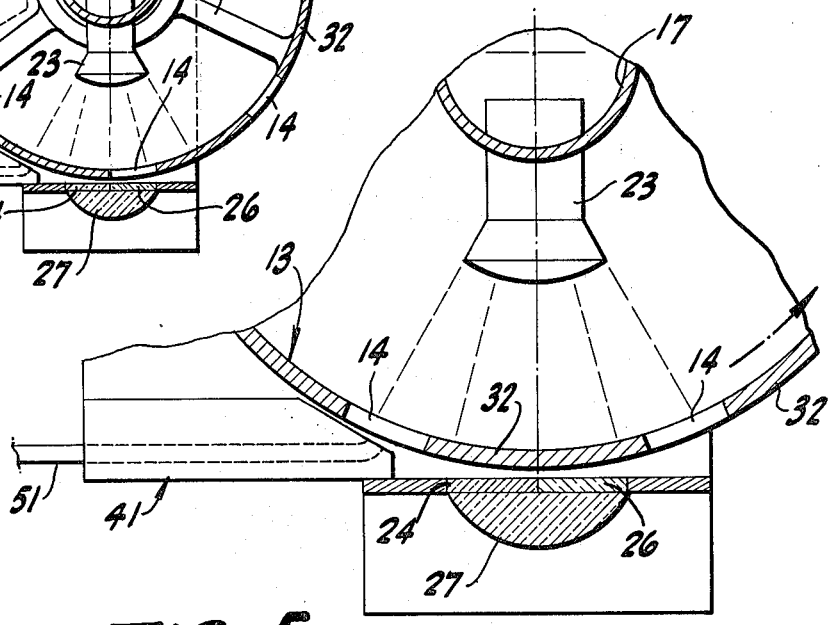
FIG. 5 is a fragmentary cross sectional view taken as in FIG. 4, but to an enlarged scale and showing both filters shielded from the illumination source.

Tach generator 29 is an AC generator producing 12 HZ per revolution. The generator 29 and the cylinder 13 are belt driven together at identical rates. Thus, the generator 29 and the cylinder 13 are in synchronism so that when the sine wave output of the tach generator 29 passes through zero potential, the apertures 14 will be centered over either the fiber optic assembly 41 (as shown in FIG. 5), the organic filter 24, or the inorganic filter 26. The import of this synchronous pulse will become clear when the demodulator circuitry is discussed immediately below.

Figures 6, 7, 11:
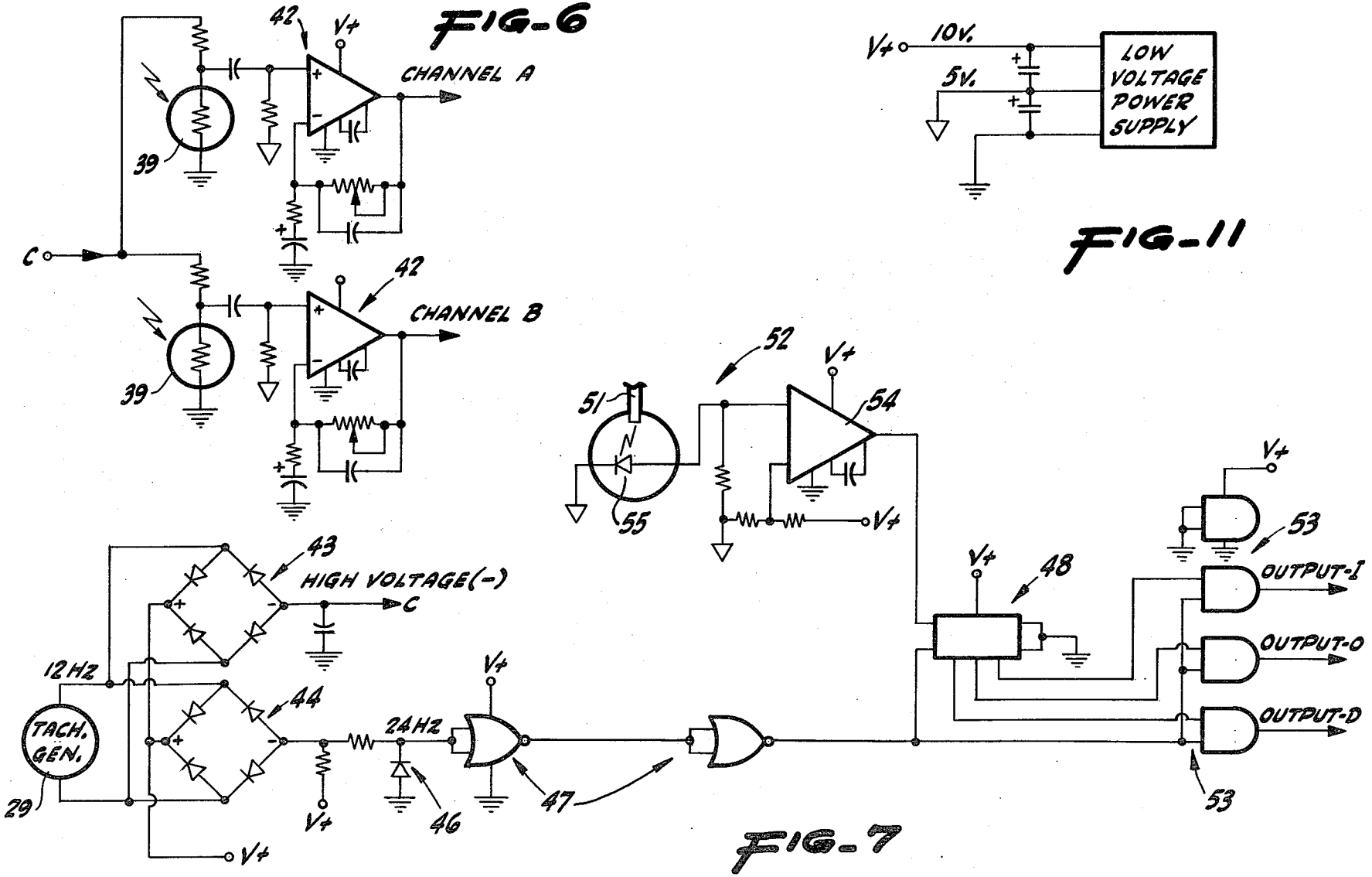
FIG. 6 is an electrical schematic of twin pre-amp channels used to amplify the infrared detector output.
FIG. 7 is an electrical schematic of the pulse generator circuitry, showing the tach generator, frequency counter with decoded output, and reset generator.

FIG. 7 shows the tach generator 29 interconnected to two bridge rectifier circuits 43 and 44. Negative high voltage for biasing the lead-sulfide detector cell 39 of preamplifier 42 (see FIG. 6) is provided at point C by negative supply circuit 43. Pulse supply circuit 44, on the other hand, rectifies the 12 HZ output of the tach generator 29 to produce a 24 HZ pulsating DC voltage. A diode 46 clips the high voltage peaks of the pulsating DC at 10 volts, leaving abbreviated pulse "valleys" of 24 HZ. Wave-shaping NOR Gates 47 further narrow the pulse width before the pulse signal is fed into a counter 48, or synchronous demodulator.

Referring now to FIG. 5, the cylinder 13 is in a "dark" position since the opaque cylinder wall section 32 is preventing light from reaching either the organic filter 24 or the inorganic filter 26. One of the apertures 14, however, is centered over the fiber optic assembly 41, permitting light to fall upon a fiber optic tube 51. The light energy is carried through the tube 51 to a reset generator 52 (see FIG. 7) where it causes photo diode 55 to conduct. The signal, augmented by amplifier 54, is fed into the counter 48. Each time the cylinder 13 reaches a "dark" position, a reset pulse causes the counter 48 to recycle, producing another series of sequential pulses to output AND Gates 53. Each sequential synchronous pulse corresponds either to a "dark" position (output D), or a near infrared pulse through the organic filter 24 (output O), or a deep infrared pulse through the inorganic filter 26 (output I).

Figure 8:
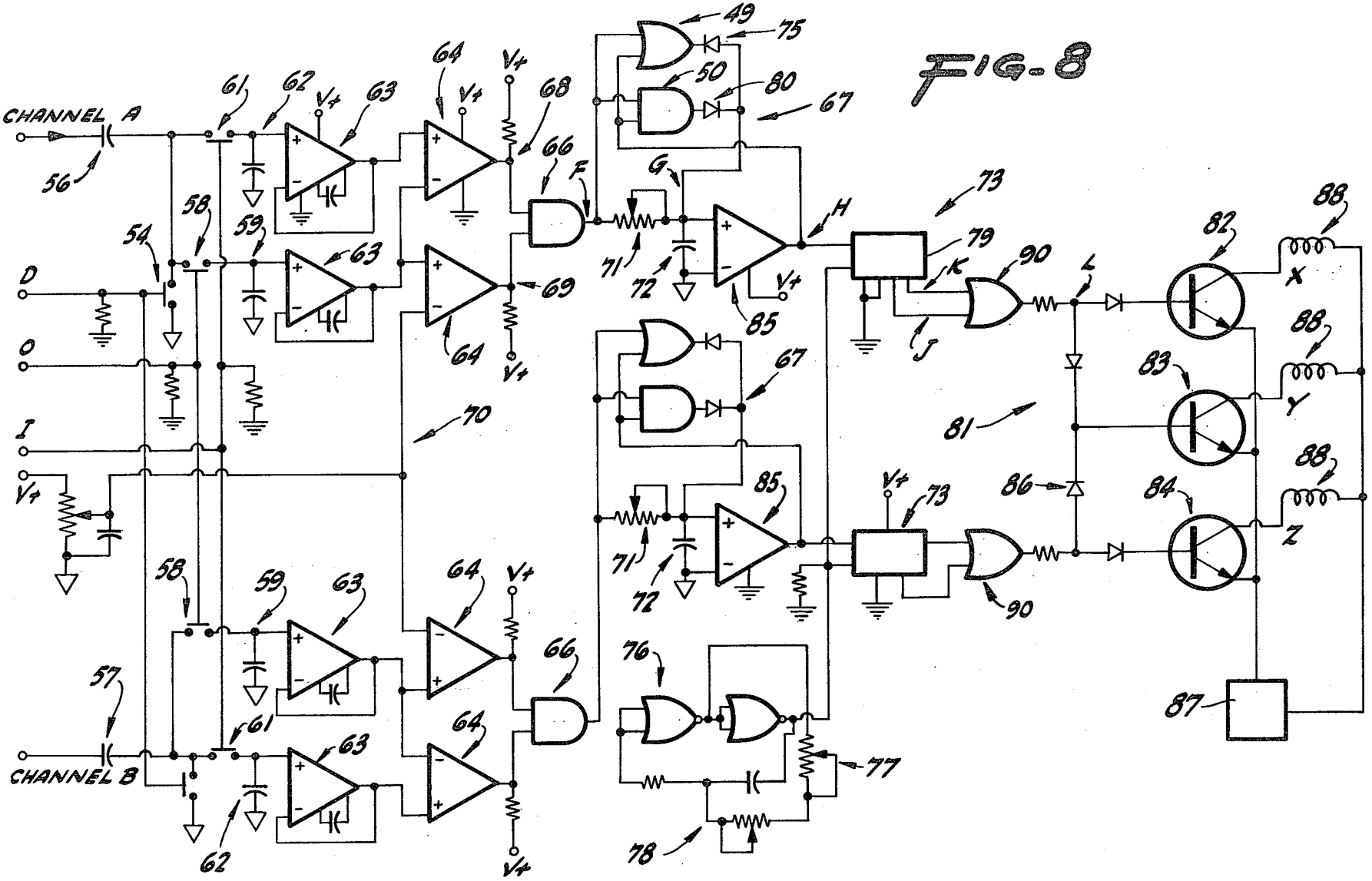
FIG. 8 is an electrical schematic of twin comparator channels showing the unity gain followers, quad comparators, sizing circuits, delay and stretch circuitry, and valve driver components.

FIG. 8 illustrates two complete channels of comparator, threshold, sizing, delay and stretch, and valve driver circuitry. Two adjacent channels are shown so that the commonality and cooperation between elements are illustrated.

With the cylinder 13 in a "dark" position, a synchronous pulse from output D of the AND Gates 53 causes a "dark" analog switch 54 to conduct. This prepares capacitors 56 and 57 in Channels A and B, respectively, in FIG. 8, for storing the instantaneous signal from their respective detector cell 39 and preamplifier 42. In the "dark" position, the only signal present is the ambient light detected and the resting gain of preamplifier 42. Thus, a "dark" signal value is stored in capacitors 56 and 57 respectively.

When the cylinder 13 rotates in counter clockwise fashion as viewed in FIG. 5, apertures 14 leave the fiber optic assembly 41 to illuminate the organic filter 24. A synchronous pulse is produced at output O from AND Gates 53 when apertures 14 and the organic filter 24 are in register. This synchronous pulse causes organic analog switches 58 to conduct, and any near infrared light energy reflected from an object passing through the sampling zone 35 is sensed by the detector or detectors 39 focused on that particular area.

Assuming in the first instance, that the object is relatively small and wholly within the field of view encompassed by a single detector 39 feeding channel A, for example, of the preamplifier 42 (see FIG. 6), the amplified signal is stored in capacitor 59 in the channel A circuit (see FIG. 8). Since the "dark" signal value (ambient+resting gain) stored in the capacitor 56 in the channel A circuit opposes the incoming composite reflected signal value (ambient+resting gain+actual signal), only the resultant, actual signal value is stored in capacitor 59.

Figure 4:
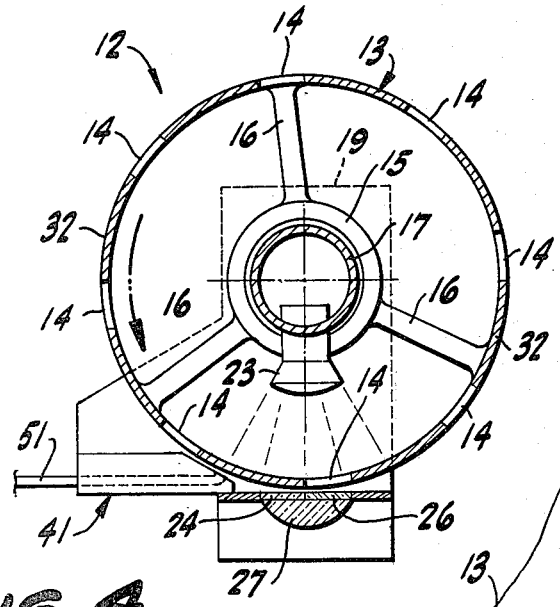
FIG. 4 is a vertical median cross sectional view, taken on the plane indicated by the line 4—4 in FIG. 3, illustrating the circumferentially positioned longitudinal apertures and adjacent twin filters with depending bar lens.

With reference now to FIG. 4, cylinder 13 continues its rotation to place the longitudinally aligned apertures 14 in register with the inorganic filter 26. A respective synchronous pulse is generated at output I from AND Gates 53 and fed to inorganic analog switches 61. As the organic switches 61 momentarily conduct, an electrical signal corresponding to any far infrared light energy reflected by the object passing through the sampling zone 35 and detected by the detector 39 is stored in the capacitor 62. In a fashion similar to the operation outlined above, the "dark" signal stored in channel A capacitor 56 subtracts from the composite reflected signal value, leaving only the true resultant value of the reflected signal stored in capacitor 62.

Cylinder 13 is rotated at such a rate that the sequential illumination of the sampling zone 35 occurs at approximately 200 times per second. This rate assures that enough information is obtained about the objects passing through the sampling zone so that a material determination can be made. At an identical rate, the reflected sequential pulses are detected and transformed into electrical signals, decoded as discrete bits of information, and finally stored for analysis, as described above. Thus, the remainder of the detailed description is devoted to a presentation of the informaion analysis circuitry and cooperating physical separation components.

FIG. 8 reveals a plurality of unity gain followers 63 serving to isolate capacitors 62 and 59 from quad comparator 64. Assuming that an object has been sensed by a detector 39 in the channel A circuit and a respective signal level concerning that object has been stored in capacitors 62 and 59, comparator 64 compares the two respective voltages across each capacitor. If the capacitor 62 voltage is higher than the capacitor 59 voltage, the object is inorganic, and the output of the comparator 64 goes high at both output legs of the channel. If the object is organic, the voltage of capacitor 59 is higher than that of capacitor 62, and the output at connection 68 goes low, while output at 69 remains high. Threshold voltage, introduced at threshold voltage source 70, establishes the lower limit of sensitivity of the comparator 64. If the signal level stored in capacitor 59 does not exceed this minimum threshold voltage, the comparator 64 does not react at all. Thus, spurious or inconsequential signals are eliminated at this point, ensuring reliable operation of the device.

Comparator AND Gates 66 requires a high signal level on both input legs to conduct a signal. Thus, if the object is organic and the voltage at connector 68 goes low, the signal is squelched at that point. If, however, the object is inorganic, a reject signal is passed to sizing circuit 67.

The object to be rejected must be of a minimum size before the reject signal is passed on. Sizing circuitry is necessary to temper the sensitivity of the reject system and assure reliable rejection of only those objects whose size demands their removal from the stream of articles.

Figure 9:
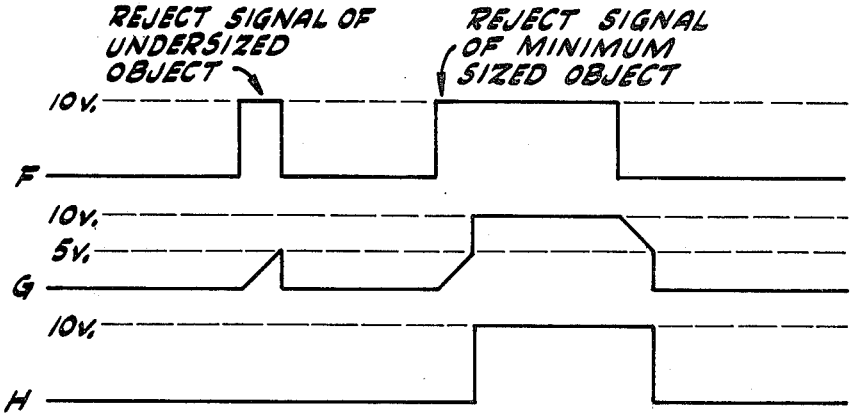
FIG. 9 is a graphic representation of reject signals of an undersized object and a minimum sized object as they pass through selected points in the sizing circuitry.

With particular reference to FIGS. 8 and 9, absent a reject signal, voltage at F, G, and H is low. Clamping diode 75 is on, keeping G low. When a reject signal is passed by comparator AND Gate 66 and appears at F, the output of OR Gate 49 goes high, thereby turning off diode 75 and removing the clamp from point G. The reject signal also passes through a variable resistor 71, serving as a manually adjustable sizing control, and begins charging capacitor 72 at a rate determined by the resultant RC Circuit.

The input of sizing comparator 85 is bridged by capacitor 72. Since the lower input leg of comparator 85 is at 5 v potential (see FIG. 11), the output at H will not go high until the potential at the upper input leg exceeds 5 v.

Assuming in the first instance that the object is undersized, capacitor 72 will not reach 5 v before the reject signal at F disappears and diode 75 clamps G and thus the capacitor 72 to ground. As FIG. 9 shows, the reject signal of the undersized inorganic object is eliminated and there is no output at H.

If the inorganic object is of minimum size, the reject signal continues to charge capacitor 72 past 5 v, resulting in an output at H, as seen in FIG. 9. When points F and H are high, sizing AND Gate 50 turns on a diode 80 clamping the capacitor 72 to 10 v, the steady value of the reject signal. When the reject signal at F disappears, the diode 80 is turned off and the RC circuit starts discharging towards zero potential. When the voltage across capacitor 72 drops below 5 v, the output at H drops to zero, turning on diode 75 and thus clamping the capacitor 72 to ground potential. The sizing circuit thereby eliminates the reject signal for undersized inorganic objects and passes the reject signal for at least minimum sized inorganic objects.

The delay and stretch circuitry 73 is necessary to account for the time discrepancy between the near instantaneous inorganic/organic determination and the relatively time-consuming and delayed physical separation of inorganic materials. As can be seen most clearly in FIG. 1, this delay is the period of time required for the object to travel from the sampling zone 35 to reach the deflection paddle 74. Thus, the reject signal for a particular object must be delayed until that object has just reached deflection paddle 74. This time-delayed reject signal must also be stretched in duration to compensate for the time lag required for the deflection paddle 74 to respond physically to an electrical signal.

The delay and stretch circuitry 73 comprises a shift register 79 fed by a variable frequency clock 76, or delay oscillator, including a coarse adjustment 77 and a fine adjustment 78. The output frequency of the clock 76 determines the speed that the reject signal passes through the shift register 79. The higher the frequency of clock 76, the shorter the delay of the reject signal through shift register 79.

Figure 10:
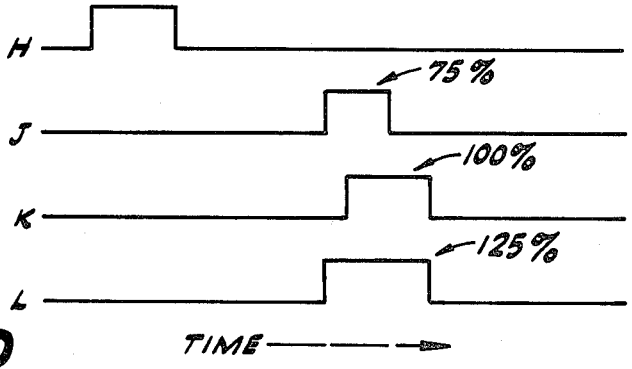
FIG. 10 is a graphic representation of the effect the delay and stretch circuitry has on a reject signal; and, FIG. 11 is a schematic of the low voltage power supply in which the V+ and ▽ symbols are respectively connected to all V+ and ▽ symbols in the other figures.

Stretch of the reject signal is accomplished by feeding two delayed outputs of the shift register 79 into a stretch OR Gate 90. FIG. 10 shows the original reject signal H, the 75% signal at J, the 100% signal at K, and the resultant 125% output at L. OR Gate 90 simply adds the two signals J and K to stretch the delayed reject signal to 125% of its original length.

The reject signal from the shift register 79 is applied to a valve driver 81 circuitry comprising transistors 82, 83 and 84. As premised earlier, the object under consideration is not large enough to be detected by two detector channels. Therefore, only a single reject signal is available, and it is fed to transistors 82 and 83. Diode 86 prevents transistor 84 from being turned on by the adjacent channel's reject signal.

The emitters of transistors 82, 83 and 84 are connected in parallel to one leg of a power supply 87. Outputs X, Y and Z of transistors 82, 83 and 84, respectively, are fed to the coils of individual solenoid-actuated air valves 88 (see FIGS. 1 and 8) which are, in turn, connected to the other leg of the power supply 87. Each air valve 88 powers a respective air cylinder 89 and interconnected deflection paddle 74, as appears most clearly in FIG. 1.

Deflection paddle 74 is held by air cylinder 89 in a normally extended, inclined position as shown in solid line FIG. 1. Until a rejection signal causes the solenoid valve 88 to redirect pressurized air from air supply 91, comestibles 34 continue to fall off the supply conveyor 33, and drop against the deflection paddle 74 which deflects them onto return conveyor 92. In response to the reject signal, however, transistors 82 and 83 turn on, activating their respective solenoid air valves. When support for the deflection paddles 74 is removed, and the impact of the descending debris 36 urges paddles 74 into a position indicated by dotted line in FIG. 1. A discharge chute 93 collects the falling debris. After the reject signal terminates, solenoid air valve 88 substantially instantaneously restores the air cylinder 89, and thus the paddle 74, to its former position.

In the situation where a larger subject article is sensed by two or more detectors 39 and subsequent circuitry determines it to be inorganic in nature, a substantially identical operation occurs. However, rather than a single reject signal appearing, two or more reject signals will be available, depending on how many channels have detected the article. Assuming that both channels A and B have detected an inorganic object, two reject signals would cooperate to turn on transistors 82, 83 and 84. Thus, support for three deflection paddles 74 would be removed and permit the larger piece of debris to pass downwardly through the discharge chute 93, followed by a return of all three paddles to deflecting position.

If ripe/unripe sorting is to be performed, the disclosed device and method for sorting are equally proficient. Depending upon the reflectivity characteristics of the ripe and unripe comestibles to be sorted, filters 24 and 26 will be modified accordingly. For example, if tomatoes are to be sorted, filter 24 should pass red light and filter 26 should pass green light. The basis for bichromatic sorting is the differential in amplitudes of light reflected from red and green tomatoes exposed to alternating pulses of red and green light.

It has been determined, experimentally, that a pulse having a wavelength in the range of 0.65 to 0.68 microns produces a usable amplitude peak for a ripe tomato, and a similar amplitude peak for an unripe tomato has been noted using an exposure pulse having a wavelength in the range of 0.50 to 0.55 microns. While exposure pulses in these general ranges will work suitably for visible light color sorting of many comestibles, precise correlation of ripe/unripe reflectivity constants for the comestible involved with the filters actually used will produce the best results.

Silicon cells, which are quite sensitive to the visible spectrum used for ripe/unripe sorting, can replace the lead sulfide cells used for inorganic/organic sorting. Thus, for ripe/unripe sorting, the detector 39 can be a silicon cell. Through the simple expedient of providing proper filters and an appropriate detector for the sorting frequencies used, the invention is completely adaptable for ripe/unripe sorting.

We claim:

1. An apparatus for sorting two materials, each material exhibiting an amplitude peak in reflected light wave energy at a different characteristic frequency, comprising:

a. illumination means for exposing a planar area defining a sampling zone to a sampling cycle, said sampling cycle including alternating pulses of light wave energy at two distinct frequencies, each of said pulses corresponding in frequency, respectively, to the characteristic frequency of amplitude peak in reflected light energy for each of the materials;

b. means for moving the materials through the sampling zone;

c. a single detector directed at the sampling zone and adapted to produce an electrical signal commensurate in amplitude to the intensity of light reflected from the materials moving through the sampling zone;

d. comparator means for producing a reject signal if the amplitude of a first electrical signal corresponding to the first of said pulses and the amplitude of a second electrical signal corresponding to the second of said pulses, bear a predetermined relationship; and, e. means for physically separating one of the materials from the other material in response to the reject signal.

2. An apparatus as in claim 1 including synchronous demodulator means, responsive to said illumination means and interconnected to said comparator means, for directing said first electrical signal and said second electrical signal to respective inputs of said comparator means in synchronism with the occurrence of a respective pulse of said alternating pulses.

3. An apparatus as in claim 2 wherein said synchronous demodulator means includes: a pulse generator adapted to emit synchronous pulses coincident with the production of each of said alternating pulses of light; counter means responsive to said synchronous pulses for splitting said synchronous pulses into discrete, respective, output channels; and, switching means interconnected to said output channels for directing said first electrical signal and said second electrical signal.

4. An apparatus as in claim 2 wherein said sampling cycle includes a dark period followed by said alternating pulses of light, said dark period corresponding to an ambient light level within the sampling zone, and further including: means for storing the ambient light signal value; means for subtracting said ambient light signal value from the composite first pulse signal value, thereby producing a resultant first pulse signal value; means for storing said resultant first pulse signal value; means for subtracting said ambient light signal value from the composite second pulse signal value, thereby producing a resultant second pulse signal value; means for storing said resultant second pulse signal value, said synchronous demodulator means being adapted to direct the first and second stored resultant signal values to respective inputs of said comparator means in synchronism with the occurrence of a respective pulse of said alternating pulses.

5. An apparatus as in claim 2 wherein one of the materials is organic and the other of the materials is inorganic and wherein the alternating pulses of light wave energy are at two distinct frequencies, the first having a wavelength approximately in the range of 0.6 to 0.95 microns and the second having a wavelength approximately in the range of 1.40 to 2.50 microns, respectively.

6. An apparatus as in claim 5 wherein said single detector includes a lead sulfide cell directed toward the sampling zone.

7. An apparatus as in claim 2 wherein one of the materials is a ripe comestible and the other of the materials is an unripe comestible and wherein the alternating pulses of light wave energy are at two distinct frequencies, the first having a wavelength approximately in the range of 0.65 to 0.68 microns and the second having a wavelength approximately in the range of 0.50 to 0.55 microns, respectively.

8. An apparatus as in claim 7 wherein said single detector includes a silicon cell directed toward the sampling zone.

9. An apparatus as in claim 2 wherein said means for moving the materials through the sampling zone comprises a supply conveyer belt.

10. An apparatus as in claim 9 wherein said means for physically separating one of the materials comprises a return conveyer belt, said return conveyer belt being subjacently coextensive with and moving in a direction opposite that of said supply conveyer belt, a deflection paddle movable between a first position angularly disposed within the downward path of articles descending from the discharge end of said supply conveyer belt in order to deflect said articles onto the adjacent extremity of said return conveyer belt, and a second position removed from said downward path by the weight of downwardly passing articles striking and displacing said paddle to permit the articles to fall without restriction; means for returning said paddle from said second position to said first position in the absence of a reject signal; and means for deactivating said paddle returning means at the direction of a reject signal.

11. An apparatus as in claim 10 further including electrical means for delaying the reject signal in order to retard the operation of said deactivating means by an amount depending upon the vertical distance between said sampling zone and said paddle.

12. An apparatus as in claim 11 further including electrical means for extending the duration of the reject signal in order to compensate for the lag time arising from the inertia of said paddle.

13. An apparatus as in claim 2 further including means for eliminating the reject signal if the reject signal does not exceed a predetermined period in duration, said perdetermined period being established by reference to the minimum size of the material to be discarded.

14. An apparatus for sorting two materials, each material exhibiting an amplitude peak in reflected light wave energy at a different characteristic frequency, comprising:

a. means for exposing a planar area defining a sampling zone to alternating pulses of light wave energy at two distinct frequencies, each of said pulses corresponding in frequency, respectively, to the characteristic frequency of amplitude peak in reflected light energy for each of the materials;

said means for exposing a planar area defining a sampling zone including (1) a frame;

(2) a hollow, right circular cylinder mounted on said frame for rotation about an axis parallel to the plane of the sampling zone, the wall of said cylinder including a plurality of circumferentially spaced elongated apertures;

(3) means for rotating said cylinder;

(4) a fixed light source mounted on said frame and extending through said cylinder, the illumination from said light source being directed from a generally central position along the axis of said cylinder outwardly toward the inner wall of said cylinder in the direction of said sampling zone;

(5) a pair of elongated coplanar light filters carried by said frame and positioned side by side adjacent the outer wall of said cylinder and parallel to said planar sampling zone, each of said filters being approximately the same width and length as said elongated apertures, and affording a characteristic optical frequency corresponding to said characteristic frequency for each of the materials to be sorted; and, (6) a lens interposed between said pair of light filters and said sampling zone, said lens being generally coextensive with said pair of light filters so that as said cylinder rotates, a beam of light emerging from each of said apertures and passing first over one filter and then over the other filter, before being obscured by an intervening cylinder wall, is directed toward said sampling zone, the materials moving through said sampling zone being thereby illuminated in each cycle by a pulse of light from one filter, then from the other filter followed by a dark period;

b. means for moving the materials through said sampling zone;

c. means for detecting the alternating pulses of light reflected from the materials moving through said sampling zone;

d. means for producing a reject signal if the detected pulses bear a predetermined relationship; and, e. means for physically separating one of the materials from the other material in response to the reject signal.

15. An apparatus as in claim 14 in which said means for detecting the alternating pulses of light includes a single detector only directed at said sampling zone, said single detector enabling the measurement of amplitude of both alternating pulses.

16. A process for sorting two materials, each material exhibiting an amplitude peak in reflected light wave energy at a different characteristic frequency, comprising the steps of:

a. subjecting a planar area defining a sampling zone to a sampling cycle, said cycle including a dark period corresponding to an ambient light level within the sampling zone, followed by alternating pulses of light wave energy at two distinct frequencies, each of said pulses corresponding in frequency, respectively, to the characteristic amplitude peak in reflected light energy for each of the materials;

b. moving the materials through the sampling zone;

c. detecting the ambient light within the sampling zone during said dark period;

d. storing an ambient light signal value;

e. detecting the reflected light from the first of said pulses;

f. subtracting said ambient light signal value from the composite first pulse signal value, thereby producing a resultant first pulse signal value;

g. storing said resultant first pulse signal value;

h. detecting the reflected light from the second of said pulses;

i. subtracting said ambient light signal value from the composite second pulse signal value, thereby producing a resultant second pulse signal value;

j. storing said resultant second pulse signal value;

k. producing a reject signal if said first and second resultant signal values bear a predetermined relationship with respect to each other; and, l. physically separating one of the materials from the other in response to said reject signal.

17. A process as in claim 16 wherein one of the materials is organic and the other material is inorganic and wherein the first of said distinct frequencies has a wavelength approximately in the range of 0.60 to 0.95 microns and the second of said distinct frequencies has a wavelength approximately in the range of 1.40 to 2.50 microns, respectively.

18. A process as in claim 16 wherein one of the materials is a ripe comestible and the other material is an unripe comestible and wherein the first of said distinct frequencies has a wavelength approximately in the range of 0.65 to 0.68 microns and the second of said distinct frequencies has a wavelength approximately in the range of 0.50 to 0.55 microns, respectively.

19. A process as in claim 16 including the step of eliminating said reject signal if its duration does not exceed a predetermined period in order to prevent physical separation of an object too small to warrant its removal.

20. A process as in claim 16 including the step of delaying the occurrence and stretching the duration of said reject signal in order to compensate, respectively, for the physical separation of the sampling zone from the area of physical removal of one material from the other and for the operational time lag in the physical separation step.

* * * * *